US005278131A

United States Patent [19]

Kawamura et al.

[11] Patent Number: 5,278,131

[45] Date of Patent: Jan. 11, 1994

[54] THERMAL TRANSFER PRINTING INK SHEET

[75] Inventors: Akihiro Kawamura; Kazuhiko Sakata, both of Tsukuba, Japan

[73] Assignee: Imperial Chemical Industries PLC, London, United Kingdom

[21] Appl. No.: 884,139

[22] Filed: May 18, 1992

[30] Foreign Application Priority Data

May 24, 1991 [JP] Japan ..... 3-120289

[51] Int. Cl.[5] ..... B41M 5/035; B41M 5/38

[52] U.S. Cl. ..... 503/227; 428/195; 428/412; 428/913; 428/914

[58] Field of Search ..... 8/471; 428/195, 412, 428/913, 914; 503/227

[56] References Cited

U.S. PATENT DOCUMENTS 4,748,151 5/1988 Murata et al. ..... 503/227

FOREIGN PATENT DOCUMENTS 0097493 1/1984 European Pat. Off. ..... 503/227

2180660 4/1987 United Kingdom ..... 503/227

*Primary Examiner*—B. Hamilton Hess

*Attorney, Agent, or Firm*—Cushman, Darby & Cushman

[57] ABSTRACT

A highly sensitive thermal transfer printing ink sheet is provided giving very little low temperature thermal transfer and irregularity of picture, even when printed in high temperature and high humidity conditions, and has an excellent long term storage stability, by using as dye-binder polycarbonate resin selected from:

(a) a polycarbonate resin of which the diol component is at least one bis(hydroxyaryl) cycloalkane, (b) a polycarbonate resin of which the diol component is a mixture of bis(hydroxyaryl) cycloalkane and at least one compound of formula I below, or (c) a mixture of polycarbonate resins of (a) or (b), or a mixed polycarbonate resin of (a) and (b), and a polycarbonate resin of which the diol component is at least one compound of formula I below,

HO-Φ-A-Φ-OH I wherein Φ represents an aryl group and A is O, S or —$CR_1R_2$—, where $R_1$ and $R_2$ are each independently a hydrogen atom or alkyl group.

8 Claims, No Drawings

THERMAL TRANSFER PRINTING INK SHEET

The invention relates to thermal transfer printing ink sheets containing thermal transfer dyes, which are used in combination with a thermal transfer receiver, and employing heating means (such as thermal heads) to transfer dye from the ink sheet to a dye-receiving layer on the receiver, corresponding to a picture signal applied to the heating means. The invention relates especially to ink sheets having an improved ink layer.

Thermal transfer printing systems have been developed in recent years for producing pictures by causing thermal diffusion dyes to transfer to a receiver sheet in response to thermal stimuli. Using an ink sheet comprising a thin substrate supporting an ink layer containing one or more such dyes uniformly spread over an entire printing area of the ink sheet, printing is effected by heating selected discrete areas of the ink sheet while the ink layer is pressed against a dye-receptive surface of a receiver sheet, thereby causing dye to transfer to corresponding areas of the receiver. The shape of the picture thus formed on the receiver is determined by the number and location of the discrete areas which are subjected to heating.

High resolution photograph-like pictures can be produced by thermal transfer printing using appropriate printing equipment, such as programmable thermal heads or laser printer, controlled by electronic picture signals derived from a video, computer, electronic still camera, or similar signal generating apparatus. Thus for example a thermal print head has a row of individually operable tiny heaters spaced to print typically six or more pixels per millimetre. Selection and operation of these heaters is effected according to the electronic picture signals fed to the printer.

Full colour pictures with a continuous gradation can be produced by printing with different coloured ink layers sequentially in like manner, and the different coloured ink layers are usually provided as discrete uniform print-size areas in a repeated sequence along the same ink sheet.

Ink sheets comprise a substrate sheet supporting a dye coat in which the thermal diffusion dye is dispersed throughout a binder which remains on the ink sheet when the dyes are transferred. Examples of binders used in the past include cellulose group resins, polyvinyl butyral, polystyrene, polyvinyl acetal, polysulphone, acrylic resin, polyester resin, and some polycarbonates, as shown in EP-A-97,493 and GB 2,180,660. When such known resins were used as the binder for a thermal transfer printing ink sheet, some problems were experienced, such as good gradation in the picture not being obtained, or optical density being insufficient. Other problems frequently included poor long term storage stability of the ink sheet, and the occurrence of low temperature thermal transfer (hereinafter simply referred to as "$LT^3$") wherein some dye molecules are also transferred in areas for which the print head is not activated by the picture signal, transfer being simply due to the contact between ink sheet and receiver during printing. This results in irregularity of the picture, and is most likely to occur when the printing is carried out in conditions of high temperature and high humidity. We have now devised a new ink layer composition having an improved balance of such properties.

According to the present invention, there is provided a thermal transfer printing ink sheet having a substrate supporting on one surface an ink layer comprising at least one thermal diffusion dye and a binder, characterised in that the binder comprises a polycarbonate resin selected from:

(a) a polycarbonate resin of which the diol component is at least one bis(hydroxyaryl) cycloalkane, (b) a polycarbonate resin of which the diol component is a mixture of bis(hydroxyaryl) cycloalkane and at least one compound of formula I below, or (c) a mixture of polycarbonate resins of (a) or (b), or a mixed polycarbonate resin of (a) and (b), and a polycarbonate resin of which the diol component is at least one compound of formula I below.

$$HO\text{-}\Phi\text{-}A\text{-}\Phi\text{-}OH \qquad \text{I}$$

wherein Φ represents an aryl group and A is O, S or $-CR_1R_2-$, where $R_1$ and $R_2$ are each independently a hydrogen atom or alkyl group.

As diol component, a preferred bis(hydroxyaryl) cycloalkane is 1,1-bis(4-hydroxyphenyl)cyclopentane. For the compounds of formula I above:

preferred bis(hydroxyaryl) alkanes include
1,1-bis(4-hydroxyphenyl)methane,
1,1-bis(4-hydroxyphenyl)ethane and
2,2-bis(4-hydroxyphenyl)propane;
preferred di(hydroxyaryl)ethers include
di(4-hydroxyphenyl) ether and
di-(4-hydroxy-3-methylphenyl)ether; and preferred
di(hydrxyaryl) sulphides include di(4-hydroxyphenyl) sulphide and
di(4-hydroxy-3-dimethylphenyl) sulphide In the polycarbonate resin or mixture of polycarbonate resins of the invention, the content of bis(hydroxyaryl) cycloalkane in the diol component should be at least 20 weight %, preferably at least 50 weight %, and it is of course acceptable for it to be 100 weight %. When the content of bis(hydroxyaryl) cycloalkane in the diol component is less than 20 weight %, an irregularity of picture can occur when a print is made in a high temperature and high humidity condition, a long term storage stability is deteriorated and $LT^3$ can also happen.

Then polycarbonate resin of the invention can be used jointly with other resins such as polyester resin, polystyrene, polyvinylacetai, acrylic resin, etc. in a range that the performance is not remarkably lowered. The amount of other resins that can be used is again dependent on the bis(hydroxyaryl) cycloalkane content, which should be at least 10 weight % of the mixture.

In order to prepare the thermal transfer printing ink sheet of the invention an ink is prepared by dissolving a binder containing the polycarbonate resin of the invention and a thermal diffusion dye in a suitable solvent, coating the ink on a base film as the substrate and drying.

The substrate can be, for example, polyester film, polyamide film, polycarbonate film, polypropylene film, or cellophane, but polyester film is especially preferable from views of mechanical strength, dimensional stability, heat resistance, etc.

As for the thermal diffusion dye to be used in the invention, dyes of the non-ionic azo group, anthraquinone group, azomethine group, methine group, indoaniline group, naphthoquinone group, nitro group, etc. can be cited.

For the ink, in addition to the binder containing the polycarbonate resin of the invention and the thermal diffusion dye, organic or inorganic fine particulate, dispersing agent, antistatiic agent, antifoaming agent, levelling agent, etc. can be incorporated if necessary. As for solvent to prepare the ink, dioxane, toluene, tetrahydrofuran, methylene chloride, Trichlene, etc. can be used, but it is preferable if it is a non-halogenic solvent.

As for a method to coat the ink on the base film as the substrate, it can be done by using, for example, a gravure coater, a reverse roll coater, a wire bar coater, a microgravure coater, an airdoctor coater, etc. The ink layer thickness is preferably 0.1–5 μm on a dry basis.

In order to form a picture by using the thermal transfer printing ink sheet of the invention, the ink layer of the thermal transfer printing ink sheet is laid on a dye receiving layer of a receiver sheet for the thermal transfer printing. The dye in the ink layer is transferred to the dye receiving layer of the receiver, by heating from the back of the ink layer, using a thermal head which generates heat in selected positions according to an electrical signal applied to the thermal head, thereby building up a picture as described hereinabove by causing dye to transfer at those positions only.

The invention is illustrated by specific embodiments of the invention described in the Examples hereinbelow, and compared with other compositions described in the Comparative Examples, wherein "parts" mean parts by weight.

Evaluation of the thermal transfer printing ink sheets was carried out by the following methods.

OPTICAL DENSITY

The thermal transfer printing ink sheet and a receiver sheet for the thermal transfer printing were laid together to contact the ink layer with the dye receiving layer. It was heated by a thermal head with 0.32 W/dot, 6 ms head heating time and 6 dots/mm dot density from the substrate side of the thermal transfer printing ink sheet. The optical density (OD) of the picture obtained was determined by SAKURA optical density meter PDA85.

STORAGE STABILITY

A roll of the thermal transfer printing ink sheet is left for 10 days in 80% RH at 60° C., and then presence or absence of dye crystal in the ink layer was observed.

$LT^3$

The thermal transfer printing ink sheet and a receiver sheet for the thermal transfer printing are laid together to contact the ink layer with the dye receiving layer, it was passed through a heating roll laminator to make surface temperature of the thermal transfer printing ink sheet at 60° C. and the change in the optical density (δ OD) of the dye receiving layer, due to the transferred dye was determined.

The thermal transfer printing ink sheets were prepared as follows.

Thermal Transfer Printing Ink Composition (a)

| | |
|---|---|
| Dye (DISPERSOL RED B-2B, from ICI) | 4.0 parts |
| 1,1'-bis(4-hydroxyphenyl)cyclohexane polycarbonate resin (molecular weight: 30000, from Mitsubishi Gas Chemical) | 3.2 parts |
| Tetrahydrofuran | 100 parts |

Thermal Transfer Printing Ink Composition (b)

| | |
|---|---|
| Dye (DISPERSOL RED B-2B, from ICI) | 4.0 parts |
| 1,1'-bis(4-hydroxyphenyl)cyclohexane polycarbonate resin (molecular weight: 80000, from Mitsubishi Gas Chemical) | 3.2 parts |
| Tetrahydrofuran | 100 parts |

Thermal Transfer Printing Ink Composition (c)

| | |
|---|---|
| Dye (DISPERSOL RED B-2B, ICI product) | 4.0 parts |
| 1,1'-bis(4-hydroxyphenyl)cyclohexane polycarbonate resin (molecular weight: 30000, from Mitsubishi Gas Chemical) | 1.5 parts |
| 2,2'-bis(4-hydroxphenyl)propane polycarbonate resin (molecular weight: 30000, from Mitsubishi Gas Chemical) | 1.6 parts |
| Tetrahydrofuran | 100 parts |

Thermal Transfer Printing Ink Composition (d)

| | |
|---|---|
| Dye (DISPERSOL RED B-2B, ICI product) | 4.0 parts |
| 1,1'-bis(4-hydroxyphenyl)cyclohexane polycarbonate resin (molecular weight: 30000, from Mitsubishi Gas Chemical) | 1.3 parts |
| 2,2'-bis(4-hydroxphenyl)propane polycarbonate resin (molecular weight: 30000, from Mitsubishi Gas Chemical) | 1.9 parts |
| Tetrahydrofuran | 100 parts |

Thermal Transfer Printing Ink Composition (e)

| | |
|---|---|
| Dye (DISPERSOL RED B-2B, from ICI) | 4.0 parts |
| 1,1'-bis(4-hydroxyphenyl)cyclohexane polycarbonate resin (molecular weight: 30000, from Mitsubishi Gas Chemical) | 0.8 parts |
| 2,2'-bis(4-hydroxphenyl)propane polycarbonate resin (molecular weight: 30000, from Mitsubishi Gas Chemical) | 2.4 parts |
| Tetrahydrofuran | 100 parts |

EXAMPLE (1)

A slip layer was formed with silicone oil on one face of a 6 μm polyester film (LUMIRROR from Toray) as a substrate film. Then, the thermal transfer printing ink composition (a) was coated on the reverse face of the slip layer, the coat was dried to form a 1.0 μm ink layer and a thermal transfer printing ink sheet (1) was obtained. The optical density, storage stability and $LT^3$ were evaluated when the thermal transfer ink sheet (1) was used. The results were shown in Table 1.

EXAMPLE (2)

The thermal transfer ink sheet (2) was formed by using the thermal transfer printing ink composition (b) in a similar manner to Example (1). The optical density, storage stability and $LT^3$ were evaluated. The results were shown in Table 1.

EXAMPLE (3)

The thermal transfer ink sheet (3) was formed by using the thermal transfer printing ink composition (c) in a similar manner to Example (1). The optical density, storage stability and $LT^3$ were evaluated. The results were as shown in Table 1.

EXAMPLE (4)

The thermal transfer ink sheet (4) was formed by using the thermal transfer printing ink composition (d) in a similar manner to Example (1). The optical density, storage stability and $LT^3$ were evaluated. The results were as shown in Table 1.

EXAMPLE (5)

The thermal transfer ink sheet (5) was formed by using the thermal transfer printing ink composition (e) in a similar manner to Example (1). The optical density, storage stability and $LT^3$ were evaluated. The results were shown as in Table 1.

Comparative Examples

Thermal transfer printing ink composition (a'), (b'), (c'), (d'), and (e') comprising compositions listed below were prepared.

Thermal Transfer Printing Ink composition (a')

| | |
|---|---|
| Dye (DISPERSOL RED B-2B, from ICI) | 4.0 parts |
| Polyvinyl butyral resin (BX-1: Sekisui Chemical Product) | 4.4 parts |
| Tetrahydrofuran | 100 parts |

Thermal Transfer Printing Ink Composition (b')

| | |
|---|---|
| Dye (DISPERSOL RED B-2a, from ICI) | 4.0 parts |
| Ethyl Cellulose resin (from Hercules) | 4.4 parts |
| Tetrahydrofuran | 100 parts |

Thermal Transfer Printing Ink Composition (c')

| | |
|---|---|
| Dye (DISPERSOL RED B-2a, from ICI) | 4.0 parts |
| 1,1'-bis(4-hydroxphenyl)hexane polycarbonate resin (molecular weight: 30000, from Mitsubishi Gas Chemical) | 3.8 parts |
| Tetrahydrofuran | 100 parts |

Thermal Transfer Printing Ink Composition (d')

| | |
|---|---|
| Dye (DISPERSOL RED B-2B, from ICI) | 4.0 parts |
| 1,1'-bis(4-hydroxphenyl)hexane polycarbonate resin (molecular weight: 80000, from Mitsubishi Gas Chemical) | 1.3 parts |
| 1,1'-bis(4-hydroxphenyl)-1''-phenylethane polycarbonate resin (molecular weight: 30000, from Mitsubishi Gas Chemical) | 1.9 parts |
| Tetrahydrofuran | 100 parts |

Thermal Transfer Printing Ink Composition (e')

| | |
|---|---|
| Dye (DISPERSOL RED B-2B, from ICI) | 4.0 parts |

-continued

| | |
|---|---|
| 1,1'-bis(4-hydroxphenyl)-1''-phenylethane polycarbonate resin (molecular weight: 30000, from Mitsubishi Gas Chemical) | 3.2 parts |
| Tetrahydrofuran | 100 parts |

Comparative Example (1)

The thermal transfer ink sheet (1') was formed by using the thermal transfer printing ink composition (a') in a similar manner to the example (1). The optical density, storage stability and $LT^3$ were evaluated. The results were shown in Table 1.

Comparative Example (2)

The thermal transfer ink sheet (2') was formed by using the thermal transfer printing ink composition (b') in a similar manner to Example (1). The optical density, storage stability and $LT^3$ were evaluated. The results were as shown in Table 2.

Comparative Example (3)

The thermal transfer ink sheet (3') was formed by using the thermal transfer printing ink composition (c') in a similar manner to the Example (1). The optical density, storage stability and $LT^3$ were evaluated. The results were as shown in Table 2.

Comparative Example (4)

The thermal transfer ink sheet (4') was formed by using the thermal transfer printing ink composition (d') in a similar manner to Example (1). The optical density, storage stability and $LT^3$ were evaluated. The results were as shown in Table 2.

Comparative Example (5)

The thermal transfer ink sheet (5') was formed by using the thermal transfer printing ink composition (e') in a similar manner to Example (1). The optical density, storage stability and $LT^3$ were evaluated. The results were as shown in Table 2

TABLE 1

| Property | Example (1) | (2) | (3) | (4) | (5) |
|---|---|---|---|---|---|
| Optical density (δ OD) | 1.0 | 1.1 | 1.1 | 1.0 | 1.1 |
| Storage stability (presence or absence of crystal) | absence | absence | absence | absence | absence |
| $LT^3$ (δ OD) | 0.08 | 0.08 | 0.08 | 0.08 | 0.08 |

TABLE 2

| Property | Comparative Example (1) | (2) | (3) | (4) | (5) |
|---|---|---|---|---|---|
| Optical density (δ OD) | 1.1 | 1.1 | 1.1 | 0.7 | 0.6 |
| Storage stability (presence or absence of crystal) | presence | presence | slight presence | absence | absence |
| $LT^3$ | 0.21 | 0.23 | 0.10 | 0.08 | 0.08 |

TABLE 2-continued

| Property | Comparative Example (1) | (2) | (3) | (4) | (5) |
|---|---|---|---|---|---|
| (δ OD) | | | | | |

EFFECT OF THE INVENTION

As shown above, when using for the thermal transfer printing ink sheet binder one of the resins which have previously been used for that purpose, it was difficult to obtain good results for all of the optical density, storage stability and $LT^3$ characteristics. However by using a polycarbonate resin of the invention, a highly sensitive thermal transfer printing ink sheet can be obtained, which gives very little low temperature thermal transfer and with low irregularity of picture, even when printed in high temperature and high humidity conditions, and has an excellent long term storage stability.

We claim:

1. A thermal transfer printing ink sheet having a substrate supporting on one surface an ink layer comprising at least one thermal transfer dye and a binder, characterized in that the binder consists essentially of at least one polycarbonate resin or resin mixture selected from:

(a) a polycarbonate resin of which the diol component consisting essentially of at least one bis(hydroxyaryl) cycloalkane, (b) a polycarbonate resin of which the diol component consisting essentially a mixture of bis(hydroxyaryl) cycloalkane and at least one compound of formula I below, or (c) a mixture of polycarbonate resins of (a) or (b), or a mixed polycarbonate resin of (a) and (b), and a polycarbonate resin of which the diol component consisting essentially of at least one compound of formula I below, $$HO\text{-}\Phi\text{-}A\text{-}\Phi OH \qquad I$$

wherein Φ represent an aryl group and A is O, S or $-Cr_1R_2-$, where $r_1$ and $R_2$ are each independently a hydrogen atom or alkyl group.

2. A thermal transfer printing ink sheet as claimed in claim 1, wherein the bis(hydroxyaryl) cycloalkane is at least 50 weight % of the diol component.

3. A thermal transfer printing ink sheet as claimed in claim 2, wherein the bis(hydroxyaryl) cycloalkane is 100 weight % of the diol component.

4. A thermal transfer printing ink sheet as claimed in any one of claims 1 to 3, wherein the bis(hydroxyaryl) cycloalkane is 1,1-bis(4-hydroxylphenyl)cyclopentane.

5. A thermal transfer printing ink sheet as claimed in claim 1, wherein the bis(hydroxyaryl) alkane of formula I is selected from 1,1-bis(4-hydroxyphenyl)methane, 1,1-bis(4-hydroxyphenyl)ethane and 2,2-bis(4-hydroxyphenyl)propane.

6. A thermal transfer printing ink sheet as claimed in claim 1, wherein the di(hydroxyaryl)ether of formula I is selected from di(4-hydroxyphenyl)ether and di(4-hydroxy-3-methylphenyl)ether.

7. The thermal transfer printing ink sheet as claimed in claim 1, wherein the di(hydroxyaryl) of sulfide formula I is selected from di(4-hydroxyphenyl)sulphide and di(4-hydroxy-3-methylphenyl)sulphide.

8. A thermal transfer printing ink sheet as claimed in any one of claims 1 to 3, wherein the bis(hydroxyaryl) cycloalkane is 1,1-bis(4-hydroxyphenyl)cyclohexane.

* * * * *